US010060171B2

(12) United States Patent
Aoshima

(10) Patent No.: US 10,060,171 B2
(45) Date of Patent: Aug. 28, 2018

(54) OPENABLE AND CLOSABLE MEMBER CONTROL APPARATUS

(71) Applicant: DENSO CORPORATION, Kariya, Aichi-pref. (JP)

(72) Inventor: Hiroki Aoshima, Iwata (JP)

(73) Assignee: DENSO CORPORATION, Kariya (JP)

( * ) Notice: Subject to any disclaimer, the term of this patent is extended or adjusted under 35 U.S.C. 154(b) by 300 days.

(21) Appl. No.: 14/951,676

(22) Filed: Nov. 25, 2015

(65) Prior Publication Data

US 2016/0153226 A1 Jun. 2, 2016

(30) Foreign Application Priority Data

Dec. 1, 2014 (JP) ..... 2014-243380

(51) Int. Cl.
*E05F 15/02* (2006.01)
*E05F 15/41* (2015.01)
*E05F 15/695* (2015.01)

(52) U.S. Cl.
CPC ..... *E05F 15/41* (2015.01); *E05F 15/695* (2015.01); *E05Y 2900/55* (2013.01)

(58) Field of Classification Search
CPC ..... E05F 15/40; E05F 15/41; E05F 15/695; E05Y 2900/55; E05Y 2400/504; E05Y 2900/50
USPC ..... 49/28, 29, 30, 31, 25, 26; 318/282, 466, 318/445
See application file for complete search history.

(56) References Cited

U.S. PATENT DOCUMENTS 7,067,996 B2 * 6/2006 Yamamoto ..... B60J 7/0573 318/280
7,952,312 B2 * 5/2011 Sakai ..... G05B 9/02 318/256
9,121,214 B2 * 9/2015 Sumiya ..... E05F 15/40
2003/0051555 A1 * 3/2003 Fukumura ..... H02H 7/0851 73/760
2004/0065498 A1 * 4/2004 Onozawa ..... G05B 9/02 180/286
2004/0104701 A1 * 6/2004 Ohshima ..... H02H 7/0851 318/445
2006/0061314 A1 * 3/2006 Shinohara ..... H02H 7/0851 318/466
2006/0119301 A1 6/2006 Shinohara
2007/0119100 A1 * 5/2007 Nakada ..... E05F 15/695 49/350
2007/0183182 A1 * 8/2007 Pribisic ..... H03K 17/955 365/145
2009/0058340 A1 * 3/2009 Sakai ..... G05B 9/02 318/434

(Continued)

*Primary Examiner* — Chi Q Nguyen
(74) *Attorney, Agent, or Firm* — Posz Law Group, PLLC

(57) ABSTRACT

In a power window apparatus, when a controller determines that a captured foreign object, which is captured between a window glass and a window frame of a door, is present, the controller executes an interrupting process that interrupts a current operation of a drive mechanism. The controller does not determine whether the captured foreign object is present in an initial mask period that is a time period from a time point of starting rotation of the electric motor to a time point, at which a rotational speed of the electric motor reaches a stable state. The initial mask period is variable based on an operational load of the electric motor.

9 Claims, 5 Drawing Sheets

(56) References Cited

U.S. PATENT DOCUMENTS

| | | | | |
|---|---|---|---|---|
| 2011/0192087 | A1* | 8/2011 | Tategami | G01D 5/2033 49/349 |
| 2011/0314740 | A1* | 12/2011 | Mori | E05F 11/445 49/349 |
| 2014/0083011 | A1* | 3/2014 | Sumiya | E05F 15/40 49/28 |

* cited by examiner

OPENABLE AND CLOSABLE MEMBER CONTROL APPARATUS

CROSS REFERENCE TO RELATED APPLICATION

This application is based on and incorporates herein by reference Japanese Patent Application No. 2014-243380 filed on Dec. 1, 2014.

TECHNICAL FIELD

The present disclosure relates to an openable and closable member control apparatus for controlling an openable and closable member.

BACKGROUND

It is a known technique to determine whether a captured foreign object, which is captured between an openable and closable member (e.g., a window glass) installed in a door of a vehicle and a corresponding neighboring member of the door located in the vicinity of the openable and closable member, is present. In this type of openable and closable member control apparatus, normally, when it is determined that the captured foreign object is present, the opening or closing operation of the openable and closable member is interrupted, and an operation, which is opposite to the interrupted operation, is executed to release the captured foreign object. With respect to the above control operation, for example, it is known that a threshold value is set for a measurement value (e.g., a rotational speed of the motor that is rotated to open or close the window glass), which varies according to a load applied to the window glass. The threshold value and the measured value are compared with each other to determine whether the captured foreign object is present.

When an operation (e.g., a switch operation) for starting the movement of the openable and closable member is performed, the drive source (the motor) is driven upon receiving a corresponding operational command. However, this type of drive source cannot be stably rotated at the start time of the drive source.

Thus, in order to correctly sense the capturing of the foreign object, an initial mask period, during which sensing of the clamping or drawing of the foreign object is not performed, is set until the rotation of the drive source is stabilized (see, for example, JP2006-322232A that corresponds to US2006/0119301A1).

As one example of this technique, in JP2006-322232A (corresponds to US2006/0119301A1), a time period from a time point of starting rotation of the motor (serving as the drive source) to a time point of reaching a stable rotational speed of the motor, is set as an activation/cancellation time period (initial mask period).

In this technique, the activation/cancellation time period is set in view of a peak of a change in the rotational speed of the motor since the time point of starting the rotation of the motor.

That is, when the peak is sensed, a decrease rate of the rotational speed of the motor is continuously measured. Furthermore, a time period Ta, which is from the time point of starting the rotation of the motor to a time point of reaching a maximum decrease rate of the rotational speed of the motor, is measured. A time period Tb, which is obtained by multiplying a vibration period of the door by a predetermined number, is added to the time period Ta, so that the activation/cancellation time period (the initial mask period) is set.

According to this technique, the appropriate cancel time period (the mask period) can be set even in a case where the assembling accuracy of the window glass is in the low level, and thereby the window glass is wobbled in multiple directions to generate a clearance between the window glass and a drive system thereof, resulting in high speed rotation of the motor in a state that is close to a no-load state of the motor, thereby causing generation of multiple peaks in the rotational speed of the motor.

However, in the above prior art technique, the slide resistance between the window glass and a weather strip is increased. Thereby, the above prior art technique cannot be used in a case where the operational load of the drive source becomes large.

This state (i.e., the state, in which the operational load of the drive source is large) occurs, for instance, at the time when the temperature the surrounding environment is low. However, the prior art technique cannot sense occurrence of this state and cannot correct the operation to set an appropriate mask period.

Thus, it has been demanded to develop a technique that can limit occurrence of erroneous reverse rotation and erroneous stop of the drive source (the motor) while maintaining a safety of an occupant of the vehicle by setting an appropriate mask period even in the state where the drive source is operated with the high load.

SUMMARY

The present disclosure is made in view of the above point.

According to the present disclosure, there is provided an openable and closable member control apparatus that includes a drive mechanism and a control device. The drive mechanism includes an electric motor, which serves as a drive source to open and close an openable and closable member installed to a door of a vehicle. The control device controls the drive mechanism to execute a first operation of the drive mechanism at a time of opening the openable and closable member and controls the drive mechanism to execute a second operation of the drive mechanism at a time of closing the openable and closable member. The control device executes a determination operation, which determines whether a captured foreign object, which is captured between the openable and closable member and a corresponding neighboring member of the door located in vicinity of the openable and closable member, is present based on a change in an operational state of the drive mechanism. When the control device determines that the captured foreign object is present through the determination operation, the control device executes an interrupting process that interrupts a current operation of the drive mechanism. The control device disables execution of the determination operation, which determines whether the captured foreign object is present, in a mask period that is a time period from a time point of starting rotation of the electric motor to a time point, at which a rotational speed of the electric motor reaches a stable state. The control device changes the mask period based on an operational load of the electric motor.

BRIEF DESCRIPTION OF THE DRAWINGS

The drawings described herein are for illustration purposes only and are not intended to limit the scope of the present disclosure in any way.

DETAILED DESCRIPTION

An embodiment of the present disclosure will be described with reference to the accompanying drawings. The following embodiment is a mere example provided for the purpose of easy understanding of the present disclosure and should not limit the scope of the present disclosure. That is, the following embodiment can be modified and improved without departing from the scope of the present disclosure, and any other modification of the following embodiment, which is equivalent to the following embodiment, should be included in the scope of the present disclosure.

Figure 1:
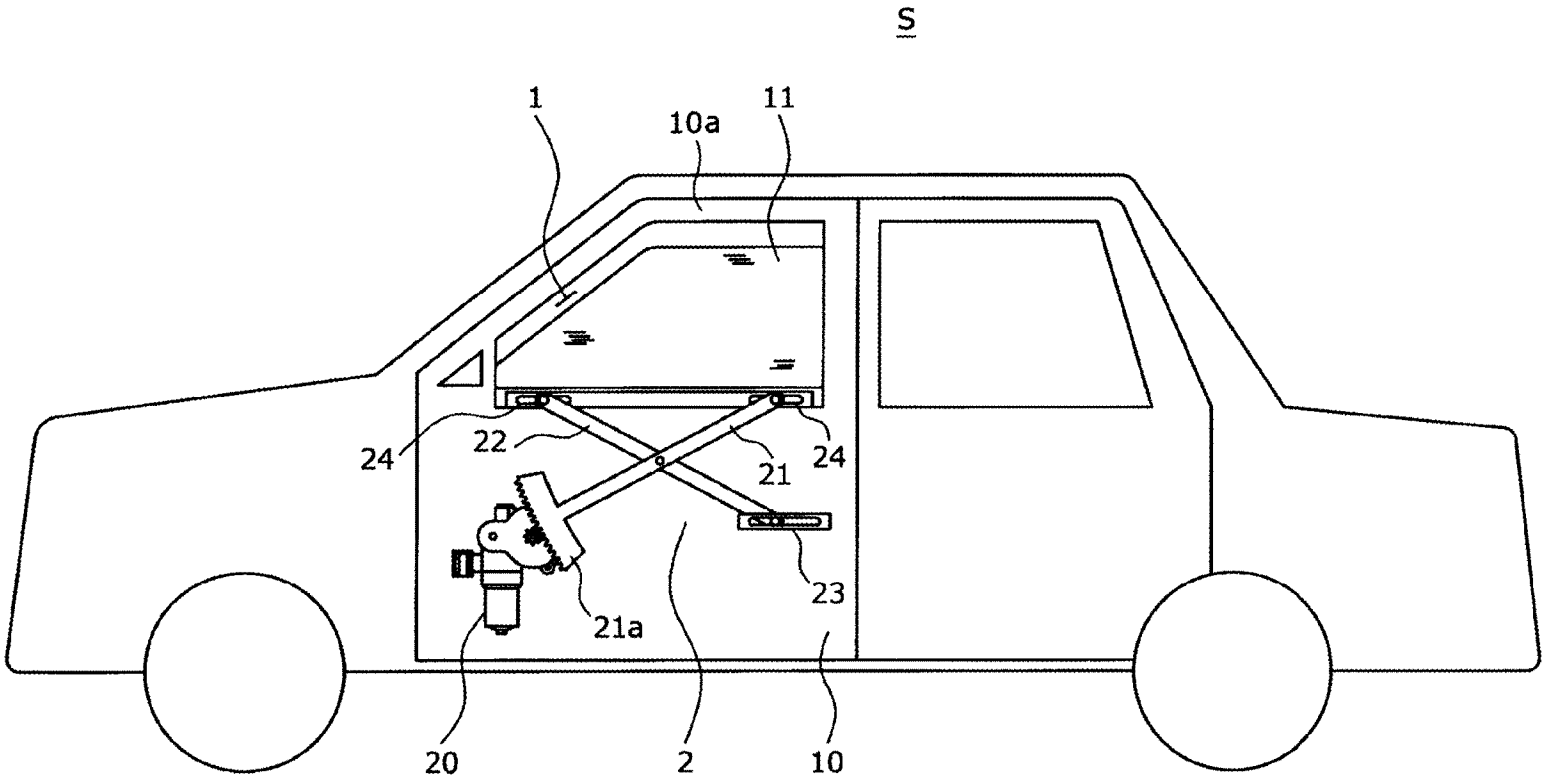
FIG. 1 is a descriptive view showing a mechanism of an openable and closable member control apparatus according to an embodiment of the present disclosure.

An openable and closable member control apparatus of the present embodiment is a power window apparatus 1 installed in a vehicle S. A structure of the power window apparatus 1 is indicated in FIG. 1. FIG. 1 is a descriptive view schematically showing a mechanism of the power window apparatus 1 of the present embodiment.

Figure 2:
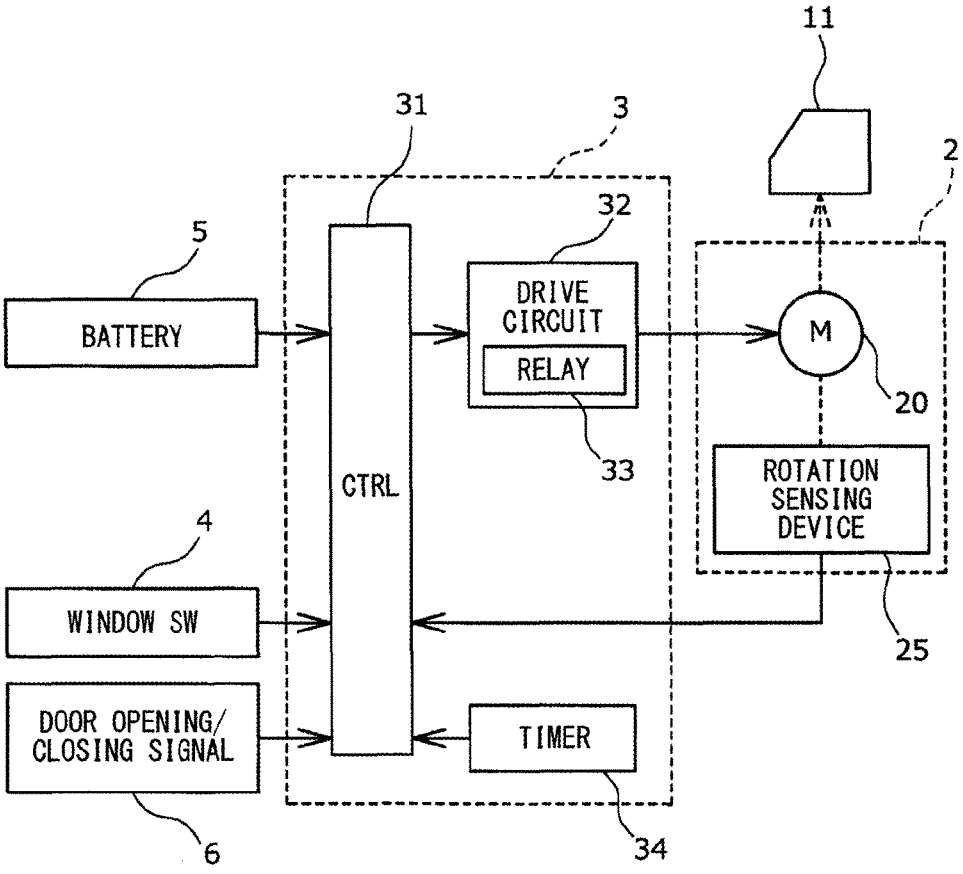
FIG. 2 is a diagram indicating an electrical structure of the openable and closable member control apparatus according to the embodiment of the present disclosure.

The power window apparatus 1 moves up and down (opens and closes) a window glass (serving as an openable and closable member) 11 installed in a door 10 of the vehicle S. The power window apparatus 1 includes a lifting mechanism 2, which serves as a drive mechanism that opens and closes the window glass 11. Now, an electrical structure of the power window apparatus 1 will be described. As shown in FIG. 2, the electrical structure of the power window apparatus 1 includes a control unit 3 and an operation switch (window switch) 4 as main constituent components. The control unit 3 controls the operation of the lifting mechanism 2. The operation switch 4 is operable by an occupant of the vehicle S to command the operation of the power window apparatus 1.

The window glass 11 is moved up and down between a full closing position (an upper moving end) and a full opening position (a lower moving end) along a rail (not shown). The lifting mechanism 2 includes an electric motor (hereinafter referred to as a motor) 20, a lifting arm 21, a driven-side arm 22, a stationary channel 23, glass-side channels 24 as main constituent components of the lifting mechanism 2. The motor 20 includes a speed reducing mechanism and is fixed to the door 10. The lifting arm 21 includes a gear 21*a*, which is configured into a fan-shape and is driven by the motor 20. The driven-side arm 22 is connected with the lifting arm 21 in a criss-cross like fashion and is pivotally supported. The stationary channel 23 is fixed to the door 10. The glass-side channels 24 are provided at a lower part of the window glass 11.

A weather strip (not shown), which is made of an elastic synthetic resin material, is installed at a lower side of a window opening of the door 10, at which the window glass 11 protrudes and retracts upon operation of the window glass 11. The weather strip is also installed along an inner peripheral portion of the window opening of the door 10, which extends along an outer peripheral edge portion of the window glass 11 when the window glass 11 is placed in the full closing position. In the closed state of the window glass 11, the weather strip provides a seal around the window glass 11. The window glass 11 is moved up and down while the window glass 11 slides along the weather strip installed at the lower side of the window opening of the door 10.

The motor 20 is rotated by an electric power supplied from the control unit 3. The motor 20 is rotatable in both of a normal rotational direction and a reverse rotational direction, which are opposite to each other. When the motor 20 is rotated, the lifting arm 21 and the driven-side arm 22 are swung. At this time, slide movements of end portions of the lifting arm 21 and of the driven-side arm 22 are limited by the corresponding channels 23, 24. Specifically, the lifting arm 21 and the driven-side arm 22 are driven as an X-linkage to upwardly or downwardly move the window glass 11.

The motor 20 has a rotation sensing device 25, which senses rotation of the motor 20 and is provided integrally in the motor 20. Although the rotation sensing device 25 is provided integrally with the motor 20 in the present embodiment, the rotation sensing device 25 may be provided separately from the motor 20 as long as the rotation sensing device 25 can sense the rotation of the motor 20. The rotation sensing device 25 includes Hall elements (e.g., two Hall elements) and outputs a pulse signal (a speed measurement signal or a rotational speed signal), which is synchronous with rotation of the motor 20, to the control unit 3. The pulse signal is outputted at every predetermined moving distance of the window glass 11 or at every predetermined rotational angle of the motor 20. That is, the rotation sensing device 25 outputs the signal that corresponds to the movement of the window glass 11, which is generally proportional to the rotational speed of the motor 20.

A relay (motor protection relay) 33 for protecting the motor 20 is provided in a drive circuit 32 of the control unit 3. The relay 33 is electrically connected to the motor 20. When a polarity of the relay 33 is changed, a flow direction of the electric current, which flows in the motor 20, is changed. When the electric current flows in a normal direction, the motor 20 is rotated in the normal rotational direction. In contrast, when the electric current flows in a reverse direction, which is opposite from the normal direction, the motor 20 is rotated in the reverse rotational direction.

The control unit 3 computes a vertical operational position of the window glass 11 based on the above-described pulse signal. The control unit 3 can compute the rotational speed of the motor 20 based on an interval of the pulse signal (more specifically, an interval between pulse edges of the pulse signal described below in detail). Also, the control unit 3 can compute a vertical moving speed of the window glass 11, which corresponds to the rotational speed of the motor 20. This feature will now be described in detail. The control unit 3 (more specifically, a controller 31 of the control unit 3 described later) senses a leading edge or a trailing edge, i.e., a pulse edge of the pulse signal inputted to the control unit 3 from the rotation sensing device 25 (e.g., from one of the two Hall elements). The control unit 3 computes the rotational speed (rotation cycle) of the motor 20 based on an interval (a period, a pulse width) between the pulse edges. The control unit 3 also senses a rotational direction of the motor 20 based on a phase difference between the pulse signals outputted from the two Hall elements.

Furthermore, the control unit 3 includes a timer 34. The timer 34 is constructed to output a clock signal, which is used in, for example, data processing and/or data computing, to the controller 31.

In this way, the control unit 3 measures the time (time period) from a time point of starting rotation of the motor 20 to a time point of reaching a predetermined pulse edge number that is set for a first initial mask period T1 described later.

As described above, the control unit 3 indirectly computes the moving speed of the window glass 11 based on the rotational speed (the rotation cycle) of the motor 20. Also, the control unit 3 specifies the moving direction (upward direction or downward direction) of the window glass 11 based on the rotational direction of the motor 20. Furthermore, the control unit 3 counts the pulse edge of the pulse signal, which correspond to the rotation of the motor 20. This pulse count value, which is counted by the control unit 3, is incremented or decremented in response to the opening or closing movement of the window glass 11. The control unit 3 specifies the operational position of the window glass 11 in the vertical direction based on the pulse count value.

Now, the control unit 3 will be described in detail. The control unit 3 includes the controller 31 and the drive circuit 32. The controller 31 is formed by a microcomputer that includes, for example, a CPU, memories (e.g., a ROM, a RAM), an input circuit and an output circuit. As shown in FIG. 2, a door opening/closing signal 6 is inputted to the controller 31. The door opening/closing signal is a signal outputted from, for example, a courtesy switch of the door 10. The controller 31 senses (determines) an open/closed state (operational state) of the door 10 based on the door opening/closing signal 6. That is, the controller 31 functions as a sensing device that senses the open/closed state of the door 10 (i.e., determines whether the door 10 is opened or closed).

The controller 31 cooperates with the drive circuit 32 and may function as a control device of the present disclosure that controls and drives the motor 20 to move the window glass 11 in the opening direction or closing direction based on the operational signal outputted from the operation switch 4. Alternatively, the entire control unit 3, which includes the controller 31, the drive circuit 32 and the timer 34, may function as the control device of the present disclosure. It is only required that the control device of the present disclosure includes at least the controller 31 among the above described devices. The operation switch 4 of the present embodiment is, for example, a rocker switch that is operable in two steps and includes an opening switch, a closing switch and an automatic switch. When the occupant operates the operation switch 4, a command signal for executing the opening or closing movement of the window glass 11 is outputted from the operation switch 4 to the controller 31. For example, when the operation switch 4 is manipulated in one step toward one end side thereof, the opening switch is turned on. Thus, a normal opening command signal for executing a normal opening movement of the window glass 11 (for executing an opening movement of the window glass 11 only through a period of manipulating the operation switch 4) is outputted from the operation switch 4 to the controller 31. The controller 31 controls the lifting mechanism 2 to execute a downward moving operation for downwardly moving the window glass 11 by rotating the motor 20 in the normal rotational direction in order to execute the normal opening movement of the window glass 11.

In contrast, when the operation switch 4 is manipulated in one step toward the other end side thereof, the closing switch is turned on. Thus, a normal closing command signal for executing a normal closing movement of the window glass 11 (for executing a closing movement of the window glass 11 only through a period of manipulating the operation switch 4) is outputted from the operation switch 4 to the controller 31. The controller 31 controls the lifting mechanism 2 to execute an upward moving operation for upwardly moving the window glass 11 by rotating the motor 20 in the reverse rotational direction in order to execute the normal closing movement of the window glass 11.

Furthermore, when the operation switch 4 is manipulated in two steps toward the one end side thereof, the opening switch and the automatic switch are both turned on. Thus, an automatic opening command signal for executing an automatic opening movement of the window glass 11 (for executing an opening movement of the window glass 11 all the way to the full opening position regardless of whether the manipulation of the operation switch 4 is stopped) is outputted from the operation switch 4 to the controller 31. When the controller 31 receives the automatic opening command signal, the controller 31 controls the lifting mechanism 2 to execute a downward continuous moving operation (corresponding to a first operation of the present disclosure) by rotating the motor 20 in the normal rotational direction until the window glass 11 reaches the full opening position.

Furthermore, when the operation switch 4 is manipulated in two steps toward the other end side thereof, the closing switch and the automatic switch are both turned on. Thus, an automatic closing command signal for executing an automatic closing movement of the window glass 11 (for executing a closing movement of the window glass 11 all the way to the full closing position regardless of whether the manipulation of the operation switch 4 is stopped) is outputted from the operation switch 4 to the controller 31. When the controller 31 receives the automatic closing command signal, the controller 31 controls the lifting mechanism 2 to execute an upward continuous moving operation (corresponding to a second operation of the present disclosure) by rotating the motor 20 in the reverse rotational direction until the window glass 11 reaches the full closing position.

The controller 31 cooperates with the rotation sensing device 25 to function as a determining unit such that the controller 31 executes a determining operation that determines whether a captured foreign object, which is captured between and is thereby compressed between the window glass 11 and a corresponding neighboring member of the door 10 located in the vicinity of the window glass 11, is present based on a change in the operational state of the motor 20. In the present embodiment, the corresponding neighboring member of the door 10 is a window frame 10*a* of the door 10. The above operation of the controller 31 will now be described more specifically. When the controller 31 receives the pulse signal from the rotation sensing device 25, the controller 31 determines whether the captured foreign object, which is captured between the window glass 11 and the window frame 10*a*, is present based on the pulse signal.

In this instance, the determination of whether the captured foreign object is present refers to determination of whether the foreign object is clamped between an upper end portion of the window glass 11 and the window frame 10*a* in the state where the window glass 11 is in the closing movement (i.e., the window glass 11 is moved in the upward direction). When the clamping of the foreign object occurs, the moving speed of the window glass 11 and the rotational speed of the motor 20 are reduced (resulting in lengthening of the rotation cycle of the motor 20). The controller 31 monitors the rotational speed of the motor 20 based on the pulse signal throughout the period of executing the closing movement of the window glass 11. The controller 31 senses, i.e., detects start of the clamping of the foreign object at the time when the rotational speed of the motor 20 begins to decrease in the closing movement. Thereafter, when the rotational speed of the motor 20 is reduced to a predetermined threshold value (a clamping determination threshold value), the controller 31 determines (confirms) that the foreign object is clamped between the window glass 11 and the window frame 10*a*.

In the state where the window glass 11 is in the opening movement, the determination of whether the captured foreign object is present refers to determination of whether the foreign object is drawn between the window glass 11 and the window frame 10*a* in the state where the window glass 11 is in the downward movement (i.e., the window glass 11 is moved in the downward direction). In this instance, the determination of whether the foreign object is drawn between the window glass 11 and the window frame 10*a* is performed in a similar procedure that is similar to that of the above described determination in the upward moving operation for upwardly moving the window glass 11. Specifically, the controller 31 senses, i.e., detects start of the drawing of the foreign object at the time when the rotational speed of the motor 20 begins to decrease in the opening movement of the window glass 11. Thereafter, when the rotational speed of the motor 20 is reduced to a preset threshold value (a drawing determination threshold value), the controller 31 determines (confirms) that the foreign object is drawn between the window glass 11 and the window frame 10*a*.

When the controller 31 determines that the capturing of the foreign object is present during the opening or closing movement of the window glass 11 (i.e., during the operation of the lifting mechanism 2), the controller 31 executes an interrupting process that interrupts the current operation of the lifting mechanism 2. For example, when the controller 31 determines that the foreign object is clamped between the window glass 11 and the window frame 10*a* in the automatic closing movement of the window glass 11, the controller 31 executes an interrupting process that interrupts the upward continuous moving operation of the lifting mechanism 2. Furthermore, when the controller 31 determines that the foreign object is drawn between the window glass 11 and the window frame 10*a* in the automatic opening movement of the window glass 11, the controller 31 executes another interrupting process that interrupts the downward continuous moving operation of the lifting mechanism 2.

Furthermore, when the controller 31 senses a change in the operational state of the door 10 from an open state to a closed state in a time period, which is from a time point before making the determination of that the foreign object is clamped or drawn to a time point after making the determination of that the foreign object is clamped or drawn, the controller 31 executes a resuming process that resumes the operation, which has been performed by the lifting mechanism 2 immediately before the interrupting process. For example, in the case where the controller 31 executes the interrupting process, which interrupts the upward continuous moving operation of the lifting mechanism 2, when the controller 31 senses that the operational state of the door 10 is changed from the open state to the closed state in the time period, which is from the time point before making the determination of that the foreign object is clamped to the time point after making the determination of that the foreign object is clamped, the controller 31 executes the resuming process that resumes the upward continuous moving operation of the lifting mechanism 2. Furthermore, in the case where the controller 31 executes the interrupting process, which interrupts the downward continuous moving operation of the lifting mechanism 2, when the controller 31 senses that the operational state of the door 10 is changed from the open state to the closed state in the time period, which is from the time point before making the determination of that the foreign object is drawn to the time point after making the determination of that the foreign object is drawn, the controller 31 executes the resuming process that resumes the downward continuous moving operation of the lifting mechanism 2.

Here, "the time point before making the determination of that the foreign object is clamped or drawn" is any time point in a time period from a time point of starting clamping or drawing of the foreign object to a time point of confirming that the foreign object is clamped or drawn. Furthermore, "the time point after making the determination of that the foreign object is clamped or drawn" is set to be a time point, at which a predetermined time period has elapsed since the time point of confirming that the foreign object is clamped or drawn. More specifically, "the time point after making the determination of that the foreign object is clamped or drawn" is set to be a time point, at which a protection time period of the relay 33 has elapsed since the time point of confirming that the foreign object is clamped or drawn.

Furthermore, when the controller 31 determines that the clamping or drawing of the foreign object is present, the controller 31 executes the interrupting process described above. Furthermore, when the controller 31 senses the change in the operational state of the door 10 from the open state to the closed state in the time period, which is from the time point before making the determination of that the foreign object is clamped or drawn to the time point after making the determination of that the foreign object is clamped or drawn, the controller 31 executes the resuming process after the execution of the interrupting process at the time point, at which the protection time period of the relay 33 has elapsed since the time point of confirming that the foreign object is clamped or drawn.

Furthermore, when the controller 31 does not sense the change in the operational state of the door 10 from the open state to the closed state in the time period, which is from the time point before making the determination of that the foreign object is clamped or drawn to the time point after making the determination of that the foreign object is clamped or drawn, the controller 31 executes a foreign object releasing process. The foreign object releasing process is a process of executing a different operation that is different from the interrupted operation, which has been executed immediately before the execution of the interrupting process. Specifically, in the case where the downward continuous moving operation is interrupted by the interrupting process, the upward moving operation of the lifting mechanism 2 is executed to move the window glass 11 in the closing direction for a predetermined distance (predetermined amount) in the subsequent foreign object releasing process. Furthermore, in the case where the upward continuous moving operation is interrupted by the interrupting process, the downward moving operation of the lifting mechanism 2 is executed to move the window glass 11 in the opening direction for a predetermined distance (predetermined amount) in the subsequent foreign object releasing process.

With the above-described construction, the power window apparatus 1 of the present embodiment can appropriately determine whether the clamping or drawing of the foreign object is present without changing a determination threshold value in view of the operational state (the open state or closed state) of the door 10. Thereby, it is possible to avoid execution of an erroneous control operation, which is based on the erroneous determination. Thereby, the control operation for controlling the opening/closing movement of the window glass 11 can be appropriately executed.

Figure 3:
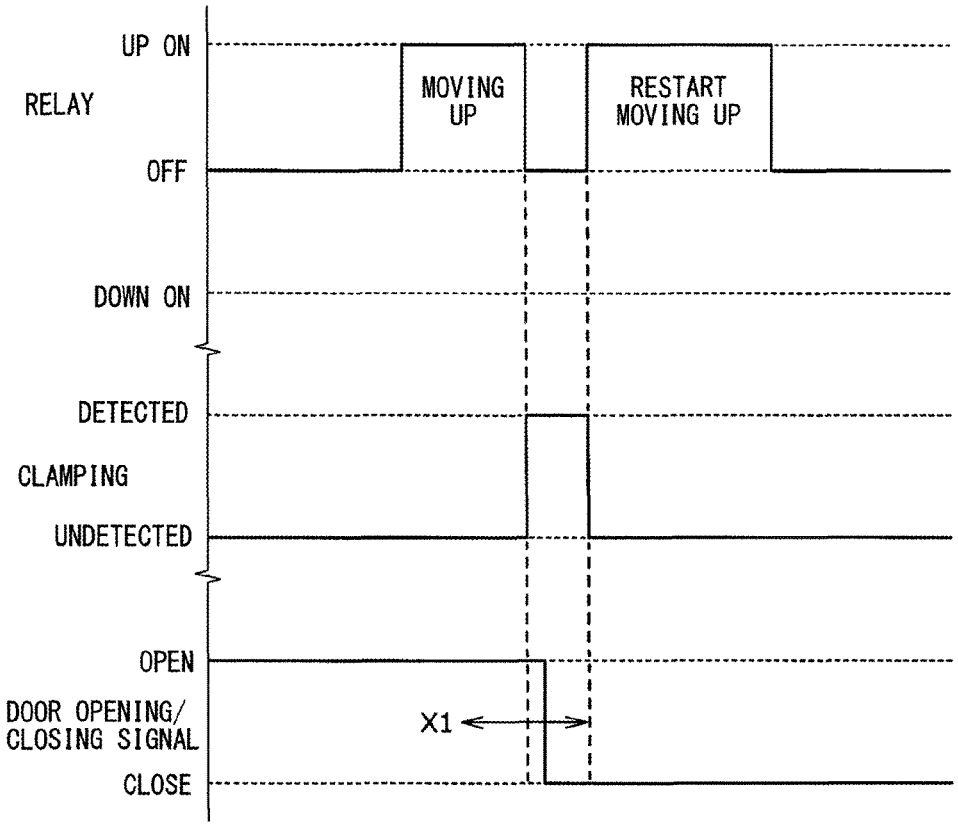
FIG. 3 is a diagram indicating an exemplary operation of the openable and closable member control apparatus according to the embodiment of the present disclosure.

Specifically, in the power window apparatus 1 of the present embodiment, as shown in the time chart of FIG. 3, when it is determined that the clamping of the foreign object is present during the closing movement of the window glass 11, the relay 33 is turned off to suspend the closing movement of the window glass 11. This procedure is the same as that of a previously proposed power window apparatus.

Thereafter, the controller 31 determines whether the operational state of the door 10 is changed from the open state to the closed state in the time period (a time period indicated by a reference sign X1 in FIG. 3), which is from the time point before making the determination of that the foreign object is clamped to the time point after making the determination of that the foreign object is clamped, the controller 31 executes determination of whether the operational state of the door 10 is changed from the open state to the closed state. When the controller 31 determines that the operational state of the door 10 is changed from the open state to the closed state in the period X1, the controller 31 cancels the determination result, which indicates the presence of the clamping of the foreign object. Furthermore, according to the present embodiment, in the case where the determination result, which indicates the presence of the clamping of the foreign object, is canceled, the controller 31 executes the resuming process that resumes the interrupted operation of the window glass 11, which has been performed by the lifting mechanism 2 immediately before the interrupting process, as shown in FIG. 3. When the determination result, which indicates the presence of the clamping of the foreign object, is canceled in this manner, the interrupted closing movement of the window glass 11 is resumed. Therefore, the switch operation for executing the full closing operation of the window glass 11, which is performed by the occupant of the vehicle in the previous step, is kept in the effective state. Specifically, according to the present embodiment, it is possible to avoid the invalidation of the switch operation of the window glass 11, which is performed by the occupant, based on the erroneous determination of the clamping/drawing of the foreign object. Thereby, the convenience of the power window apparatus 1 is improved.

In contrast, in the case where it is determined that the operational state of the door 10 has not been changed from the open state to the closed state, the credibility of the determination result, which indicates the presence of the clamping of the foreign object, is high, and thereby this determination result is used. Thereafter, the downward moving operation of the lifting mechanism 2 is executed as the foreign object releasing process. In this way, the foreign object can be appropriately eliminated.

Now, an initial mask period function, which is implemented in the power window apparatus 1 having the clamping and drawing sensing function for sensing the clamping and the drawing of the foreign object, will be described.

This mask period function is a function of disabling the clamping and drawing sensing function in a stabilizing time period (an unstable time period), during which the rotation of the motor 20 is not yet stabilized, at the time of starting the operation of the power window apparatus 1. In other words, when the controller 31 executes the mask period function, the controller 31 disables execution of the determination operation, which determines whether the captured foreign object is present, in the stabilizing time period (an initial mask period T described below) that is the time period from the time point of starting rotation of the motor 20 to the time point, at which the rotational speed of the motor 20 reaches the stable state (a predetermined level of stable state).

Figure 4:
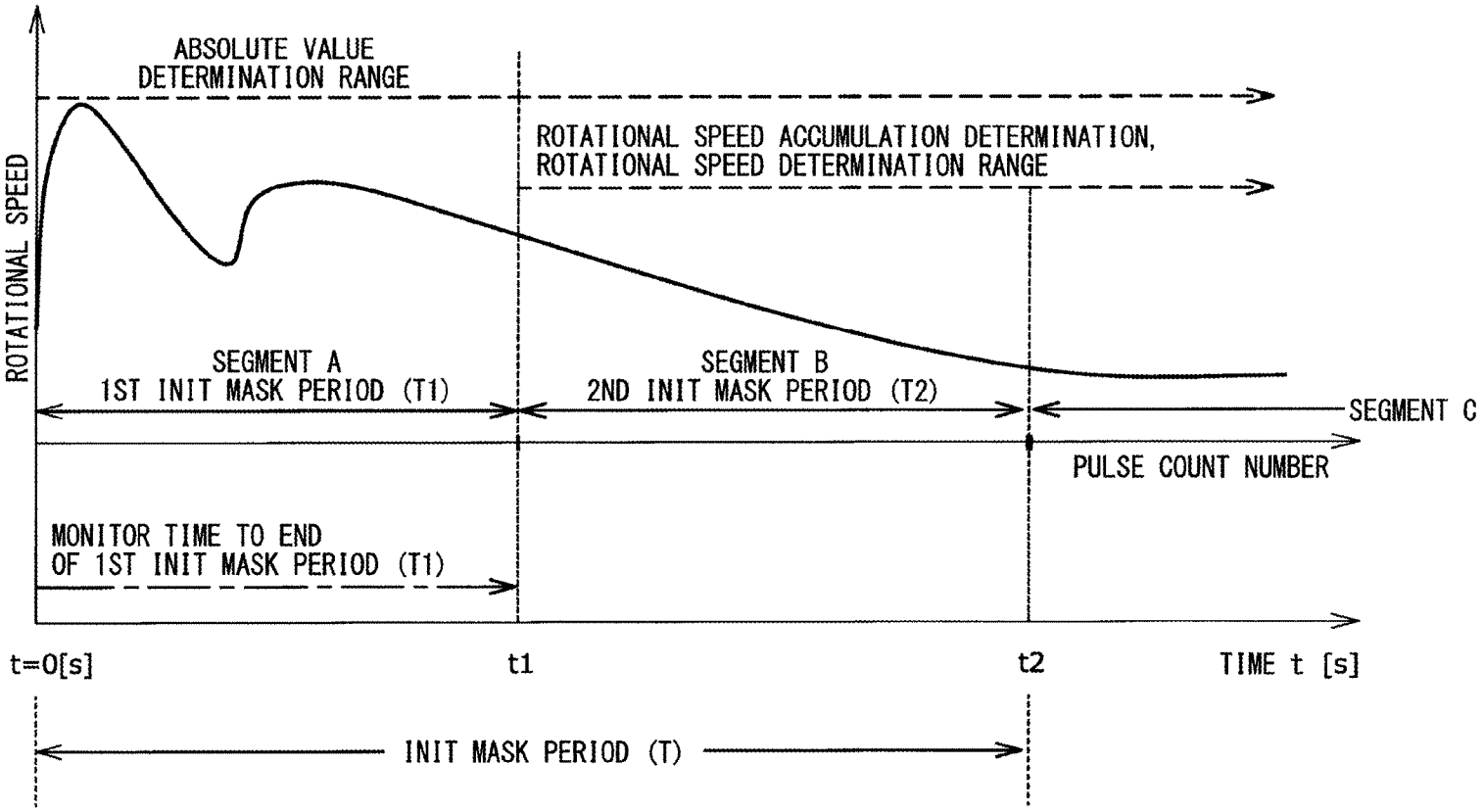
FIG. 4 is a diagram indicating a relationship between a rotational speed of an electric motor of the openable and closable member control apparatus and the time according to the embodiment of the present disclosure.

As shown in FIG. 4, according to the present embodiment, a degree of an operational load of the motor 20 is evaluated based on a value of the rotational speed of the motor 20, which serves as an index.

As indicated in FIG. 4, the rotational speed of the motor 20 is not stable in a segment A, which is immediately after the start of the rotation of the motor 20, so that two peaks are formed in the graph indicating the relationship between the rotational speed of the motor 20 and the time. In a subsequent segment B, which is after the segment A, the rotational speed of the motor 20 gradually approaches to the stable state.

At the end of the segment B, the rotational speed is stabilized. Thus, the initial mask period function is canceled in a segment C, which begins from the end of the segment B, and thereby the normal clamping and drawing sensing function is enabled in the segment C. That is, the controller 31 enables the execution of the determination operation, which determines whether the captured foreign object is present.

In the present embodiment, the initial mask period (also simply referred to as a mask period) T, during which the initial mask period function is executed, is divided into a first initial mask period (also simply referred to as a first mask period) T1 and a second initial mask period (also simply referred to as a second mask period) T2. Thereby, there is established a relationship of that: T=T1+T2=Segment A+Segment B.

The first initial mask period T1 is a time period (the segment A) from a time point (t=0) of starting rotation of the motor 20 to a time point t1.

The first initial mask period T1 (a segment from t0 to t1) is a fixed value that is set as a period to be elapsed until the time point of reaching the predetermined pulse edge number.

As described above, the control unit 3 (the controller 31) counts the number of pulse edges (pulse edge number). When the counted pulse edge number, which is counted by the control unit 3 (the controller 31), reaches a predetermined pulse edge number p1, the first initial mask period T1 ends. This time point, at which the first initial mask period T1 ends, is denoted as the time point t1. Also, the time point t1, at which the counted pulse edge number reaches the predetermined pulse edge number p1, serves as a relay point.

Furthermore, the predetermined pulse edge number p1 serves as a first pulse edge number (also referred to as a first initial pulse edge number).

Furthermore, the second initial mask period T2 is a period from the time point t1 of ending the initial mask period T1 to a time point t2. The time point t2 is a time point that is equal to or around the time point, at which the rotational speed of the motor 20 reaches the stable state.

A second initial mask period base value T21 (a time period to be elapsed until the time point of reaching the pulse edge number p2), which serves as a reference value, is set as the second initial mask period T2.

In a case where a predetermined condition is satisfied through feedback of information of the first initial mask period T1, the second initial mask period T2 is corrected and is thereby set as a time period to be elapsed until a time point of reaching a pulse edge number p3. In a case where the predetermined condition is not satisfied, the second initial mask period base value T21 (the time period to be elapsed up the time point of reaching the pulse edge number p2) is directly set as the second initial mask period T2.

That is, the second initial mask period T2 is a variable value (the predetermined pulse edge number p2 or the pulse edge number p3), which varies depending on the condition.

The predetermined pulse edge number p1 and the predetermined pulse edge number p2 are the fixed values, which are determined for each corresponding type of motor through a test (experiment).

The predetermined pulse edge number p2 serves as a second pulse edge number (also referred to as a second initial pulse edge number). The pulse edge number p3 serves as a third pulse edge number (also referred to as a third initial pulse edge number). The pulse edge number p1, the pulse edge number p2 and the pulse edge number p3 are increased in this order (i.e., p1<p2<p3).

The above described condition and the control operation will now be described in detail.

First of all, a process of setting the second initial mask period T2 executed by the control unit 3 (the controller 31) will be described with reference to FIG. 5.

Figure 5:
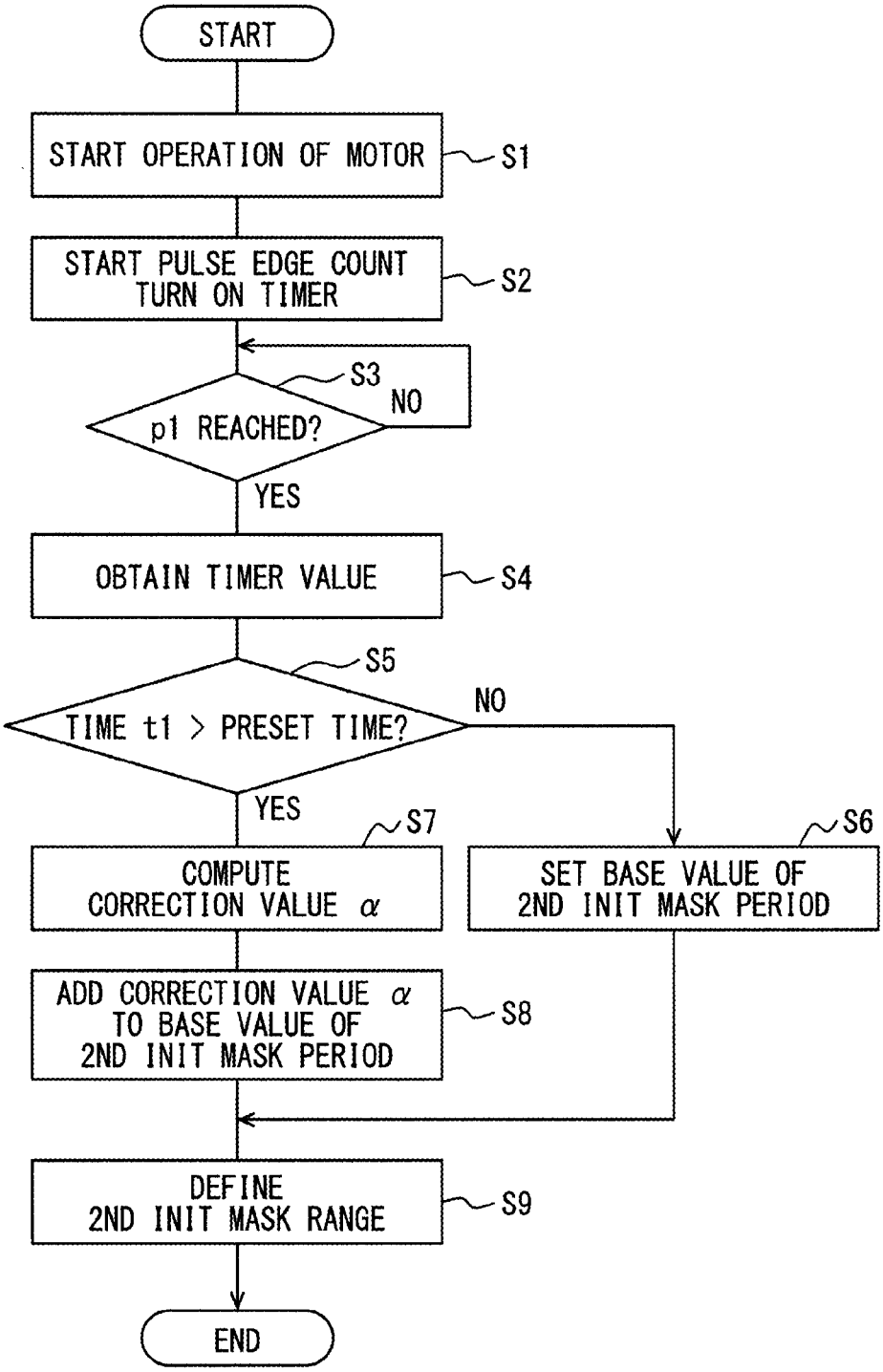
FIG. 5 is a flowchart indicating a flow of setting a mask period in a control operation of the openable and closable member according to the embodiment of the present disclosure.

The process of FIG. 5 starts when the corresponding switch of the operation switch 4, which drives the power window apparatus 1, is turned on.

When the process starts, the operation (the rotation) of the motor 20 starts at step S1. Then, at step S2, counting of the pulse edge number (i.e., counting of the number of the pulse edges) is started, and the timer 34 is turned on. Thus, the counting of the pulse edge number with the controller 31 and the measurement of the time period with the timer 34 begin when the motor 20 starts the rotation.

Next, at step S3, it is determined whether the predetermined pulse edge number p1, which is set as the pulse edge number that corresponds to the end of the first initial mask period T1, has been reached.

When it is determined that the predetermined pulse edge number p1, which is set as the pulse edge number that corresponds to the end of the first initial mask period T1, has not been reached at step S3 (i.e., NO at step S3), the operation returns to step S3 to monitor the pulse edge number until the counted pulse edge number reaches the predetermined pulse edge number p1.

When it is determined that the predetermined pulse edge number p1, which is set as the pulse edge number that corresponds to the end of the first initial mask period T1, has been reached at step S3 (i.e., YES at step S3), the operation proceeds to step S4. At step S4, the value of the timer 34 (the time at the time point t1) at this time point is obtained. That is, an elapsed time period from the time point of starting the operation of the power window apparatus 1 to the time point of ending the first initial mask period is obtained.

Next, at step S5, it is determined whether the obtained value of the timer 34 (the time at the time point t1) is larger than the predetermined time (preset time). That is, it is determined whether the time period to be elapsed until the time point of reaching the pulse edge number p1, which is set as the first initial mask period, is longer than the predetermined time period.

In a case where the obtained value of the timer 34 (the time at the time point t1) is not larger than the predetermined time (i.e., NO at step S5), the operation proceeds to step S6. At step S6, the second initial mask period base value T21 (the predetermined pulse edge number p2) is set as the second initial mask period T2 (more specifically, the predetermined pulse edge number p2 is set as the pulse edge number to be counted at the end of the second initial mask period T2). Then, at step S9, a range of the second initial mask period T2 is defined (confirmed), and the operation is terminated. As described above, the second initial mask period base value T21 is determined as the time period to be elapsed until the time point of reaching the pulse edge number p2.

In a case where the obtained value of the timer 34 (the time at the time point t1) is larger than the predetermined time (i.e., YES at step S5), the operation proceeds to step S7. At step S7, a second initial mask period correction value α (serving as a correction value of the present disclosure) is computed.

The second initial mask period correction value α is determined based on a spent time (a spent time length) of the first initial mask period T1.

Specifically, a time difference (Δt) between the spent time (time point t1) of the first initial mask period T1, which is actually spent to reach the predetermined pulse edge number p1, and the predetermined time, which is the reference value, is computed. Then, the number of pulse edges, which corresponds to the time difference Δt, is computed and is set as the second initial mask period correction value α. In other words, the second initial mask period correction value α is the number of pulse edges, which should be counted throughout the time difference Δt.

Specifically, the second initial mask period correction value α is computed with the following equation.

Second Initial Mask Period Correction Value
$\alpha$=Pulse Edge Number $p1$×(Time difference $\Delta t$/Spent Time $t1$)

Then, at step S8, a value, which is obtained by adding the second initial mask period correction value α to the second initial mask period base value T21 (the predetermined pulse edge number p2), is set as the second initial mask period T2. Thereafter, at step S9, the range of the second initial mask period T2 is defined, i.e., confirmed, and the operation is terminated.

That is, the pulse edge number p3, which is computed with the following equation, is set as the second initial mask period T2, and the operation is terminated.

Pulse Edge Number $p2$+Second Initial Mask Period Correction Value $\alpha$=Pulse Edge Number $p3$ That is, in the first initial mask period T1, a degree of delay, which is equal to or larger than a predetermined value, reflects an excess load applied to the power window apparatus 1 (the motor 20). Therefore, the pulse edge number, which corresponds to this delay, is added to the second initial mask period base value T21 as the second initial mask period correction value α, so that the delay, which corresponds to the excess load, is reflected into the second initial mask period T2 to lengthen the second initial mask period T2.

In other words, although the first initial mask period T1 is the fixed value, the second initial mask period T2 is the variable value (in the present embodiment, the time period to be elapsed until the time point of reaching the pulse edge number p2 or the pulse edge number p3). Therefore, the flexible control operation is possible.

As described above, in the case where the time period from the time point of starting the rotation of the motor 20 to the end of the first initial mask period T1, i.e., the time period from the time point of starting the rotation of the motor 20 to the time point of counting the predetermined pulse edge number p1, which is set as the first initial mask period T1, does not exceed the predetermined time period, it is determined that the current state is the normal start state of the power window apparatus 1 (the motor 20), and thereby there is no particular problem. Thus, the predetermined pulse edge number p2 is set as the second initial mask period T2. Then, the second initial mask period T2 ends when the predetermined pulse edge number p2 is reached.

However, in the case where the time period from the time point of starting the rotation of the motor 20 to the end of the first initial mask period T1, i.e., the time period from the time point of starting the rotation of the motor 20 to the time point of counting the predetermined pulse edge number p1, which is set as the end of the first initial mask period T1, exceeds the predetermined time period, it is determined that the current state is the state (the state that is not the normal start state), in which the large operational load is generated in the power window apparatus 1 (thereby requiring an additional time period to stabilize the rotational speed of the motor 20). Thus, the predetermined pulse edge number p2 is corrected by extending the second initial mask period base value T21 (the predetermined pulse edge number p2) by the amount of the second initial mask period correction value $\alpha$.

In this way, the rotational speed of the motor 20 can be reliably stabilized within the second initial mask period T2.

In the prior art technique, the first initial mask period T1 and the second initial mask period T2 are both set as the fixed values (p1, p2), respectively. However, according to the present embodiment, the second initial mask period T2 is set through the feedback of the information of the first initial mask period T1. Specifically, the second initial mask period T2 is the variable value.

Therefore, the rotational speed of the motor 20 is reliably stabilized within the second initial mask period T2, and thereby erroneous reverse rotation or erroneous stop of the motor 20 can be limited.

Here, it should be noted that the state, in which the large operational load is generated in the power window apparatus 1, can be a state where the power window apparatus 1 is placed in the low temperature environment or is installed to a vehicle door, at which a large operational load is generated.

What is claimed is:

1. An openable and closable member control apparatus comprising:

a drive mechanism that includes an electric motor, which serves as a drive source to open and close an openable and closable member installed to a door of a vehicle; and a control device that is configured to control the drive mechanism, wherein:

the control device is configured to execute a determination operation, which determines whether a captured foreign object, which is captured between the openable and closable member and a corresponding neighboring member of the door located in vicinity of the openable and closable member, is present based on a change in an operational state of the drive mechanism;

the control device is configured to execute an interrupting process that interrupts a current operation of the drive mechanism in response to determining that the captured foreign object is present at the determination operation;

the control device is configured to disable execution of the determination operation, which determines whether the captured foreign object is present, in a mask period that is a time period from a time point of starting rotation of the electric motor to a time point, at which a rotational speed of the electric motor reaches a stable state; and the control device is configured to change a length of the mask period based on an operational load of the electric motor.

2. The openable and closable member control apparatus according to claim 1, wherein the control device is configured to determine the operational load of the electric motor based on a rotational speed of the electric motor.

3. The openable and closable member control apparatus according to claim 1, wherein the control device is configured to change the length of the mask period in response to determining that the operational load of the electric motor is larger than a predetermined operational load.

4. The openable and closable member control apparatus according to claim 1, wherein:

the mask period is divided into:

a first mask period that is from the time point of starting the rotation of the electric motor to a relay point; and a second mask period that is from the relay point to a time point that is equal to or around the time point, at which the rotational speed of the electric motor reaches the stable state;

the first mask period is a fixed value; and the second mask period is a variable value that is corrected through feedback of a state of the operational load of the electric motor in the first mask period.

5. The openable and closable member control apparatus according to claim 4, wherein:

the control device is configured to count a pulse edge number, which corresponds to the rotation of the electric motor, and the control device is configured to monitor an elapsed time period with a timer from the time point of starting the rotation of the electric motor;

a time period, which is from the time point of starting the rotation of the electric motor to a time point of counting a first pulse edge number by the control device, is set as the first mask period, while the first pulse edge number is a predetermined pulse edge number that is specific to the electric motor;

in a case where a time period from the time point of starting the rotation of the electric motor to an end of the first mask period does not exceed a predetermined time period, a time period, which is from the relay point to a time point of counting a second pulse edge number by the control device, is set as the second mask period, while the second pulse edge number is another predetermined pulse edge number that is specific to the electric motor; and in a case where the time period from the time point of starting the rotation of the electric motor to the end of the first mask period exceeds the predetermined time period, a time period, which is from the relay point to a time point of counting a third pulse edge number by the control device, is set as the second mask period, while the third pulse edge number is obtained by adding a pulse edge number, which is computed as a time period correction value, to the second pulse edge number.

6. The openable and closable member control apparatus according to claim 5, wherein the time period correction value is a value obtained by computing a pulse edge number that corresponds to a difference between:

an actual measured time period from the time point of starting the rotation of the electric motor to the time point of counting the first pulse edge number; and the predetermined time period.

7. The openable and closable member control apparatus according to claim 1, wherein:

the drive mechanism includes a rotation sensing device that senses the rotation of the electric motor and outputs a pulse signal, which is synchronous with the rotation of the electric motor;

the control device includes:

a controller that controls the drive mechanism; and a timer that measures time;

the controller is configured to begin counting of a pulse edge number of the pulse signal in response to starting of the rotation of the electric motor;

the controller determines whether an elapsed time period, which is measured with the timer and is from the time point of starting the rotation of the electric motor to a time point of counting the first pulse edge number, is equal to or less than a predetermined time period in response to determining that the pulse edge number counted by the controller reaches a first pulse edge number in the mask period;

the controller ends the mask period and enables the execution of the determination operation at a time point, at which the pulse edge number counted by the controller reaches a second pulse edge number that is larger than the first pulse edge number in response to determining that the elapsed time period, which is measured with the timer and is from the time point of starting the rotation of the electric motor to the time point of counting the first pulse edge number, is equal to or less than the predetermined time period; and the controller ends the mask period and enables the execution of the determination operation at a time point, at which the pulse edge number counted by the controller reaches a third pulse edge number that is larger than the second pulse edge number in response to determining that the elapsed time period, which is measured with the timer and is from the time point of starting the rotation of the electric motor to the time point of counting the first pulse edge number, is longer than the predetermined time period.

8. The openable and closable member control apparatus according to claim 7, wherein the controller increases the third pulse edge number in response to an increase in a difference between:

the elapsed time period, which is measured with the timer and is from the time point of starting the rotation of the electric motor to the time point of counting the first pulse edge number; and the predetermined time period.

9. The openable and closable member control apparatus according to claim 1, wherein:

the drive mechanism includes a rotation sensing device that detects a rotation of the electric motor;

the control device is configured to determine whether the operational load of the electric motor is larger than a predetermined value based on an output of the rotation sensing device during the mask period; and the control device is configured to lengthen the mask period by delaying an end of the mask period in response to determining that the operational load of the electric motor is larger than the predetermined value.

* * * * *